US012291374B2

(12) United States Patent
McCoy

(10) Patent No.: US 12,291,374 B2
(45) Date of Patent: May 6, 2025

(54) PRESSURE RELIEF PIVOT ATTACHED OR INTEGRATED TO AN UNDERSIDE BALANCING POINT OF A PALLET

(71) Applicant: Robert Asa McCoy, Piedmont, SC (US)

(72) Inventor: Robert Asa McCoy, Piedmont, SC (US)

( * ) Notice: Subject to any disclaimer, the term of this patent is extended or adjusted under 35 U.S.C. 154(b) by 38 days.

(21) Appl. No.: 18/186,294

(22) Filed: Mar. 20, 2023

(65) Prior Publication Data

US 2023/0294873 A1 Sep. 21, 2023

Related U.S. Application Data

(60) Provisional application No. 63/321,427, filed on Mar. 18, 2022.

(51) Int. Cl.
*B65D 19/40* (2006.01)

(52) U.S. Cl.
CPC .... *B65D 19/40* (2013.01); *B65D 2519/00318* (2013.01); *B65D 2519/00781* (2013.01)

(58) Field of Classification Search
CPC ..... B65D 19/40; B65D 19/0026; B65D 19/0095; B65D 2519/0038; B65D 2519/00781; B65D 2519/00333; B65D 2519/00034; B65D 2519/00069; B65D 2519/00104
USPC ..... 108/51.11, 20, 139, 57.33, 56.3; 248/346.02, 349.1
See application file for complete search history.

(56) References Cited

U.S. PATENT DOCUMENTS

| | | | | |
|---|---|---|---|---|
| 2,774,599 | A * | 12/1956 | Dunn | A63F 3/00895 273/285 |
| 2,923,512 | A * | 2/1960 | Campbell | B65D 19/0026 108/55.5 |
| 3,269,336 | A | 8/1966 | Naylor et al. | |
| 3,948,344 | A | 4/1976 | Johnson et al. | |
| 4,013,020 | A | 3/1977 | Schoeller et al. | |
| 4,815,926 | A | 3/1989 | Chaffee et al. | |
| 4,834,000 | A | 5/1989 | Darnell et al. | |
| 5,117,762 | A | 6/1992 | Shuert | |
| 5,873,477 | A * | 2/1999 | Jago | B65D 1/0276 215/373 |
| 6,216,608 | B1 * | 4/2001 | Woods | B65D 19/0095 108/57.25 |
| 6,807,911 | B2 | 10/2004 | Carson et al. | |
| 8,813,659 | B2 | 8/2014 | Kuo et al. | |
| 8,888,110 | B2 | 11/2014 | Sadeh et al. | |
| 9,045,253 | B2 | 6/2015 | Hacko et al. | |
| 9,828,136 | B2 | 11/2017 | Randall et al. | |
| 10,604,299 | B1 | 3/2020 | Soehnlen et al. | |
| 10,961,096 | B1 | 3/2021 | Andersen et al. | |
| 11,142,370 | B2 | 10/2021 | Jefferson | |
| 2007/0186827 | A1 | 8/2007 | Loftus et al. | |
| 2010/0212982 | A1 | 8/2010 | Lin | |

(Continued)

*Primary Examiner* — Janet M Wilkens
(74) *Attorney, Agent, or Firm* — Dunlap Bennett & Ludwig, PLLC

(57) ABSTRACT

A pivot point for pallets is provided to enable rotation of the pallet rotation about the pivot point when loaded and seated on a floor. The pivot point may be a pressure relief pivot spherical cap or spherical dome that is attached or integrated to a balancing point along an underside of the bottom deck of the pallet.

5 Claims, 3 Drawing Sheets

(56) References Cited

U.S. PATENT DOCUMENTS

| | | | | |
|---|---|---|---|---|
| 2013/0037680 | A1* | 2/2013 | Bushkovskiy | F16C 17/08<br>248/349.1 |
| 2022/0144578 | A1* | 5/2022 | Dixon | B65D 85/04 |

* cited by examiner

PRESSURE RELIEF PIVOT ATTACHED OR INTEGRATED TO AN UNDERSIDE BALANCING POINT OF A PALLET

CROSS-REFERENCE TO RELATED APPLICATION

This application claims the benefit of priority of U.S. provisional application No. 63/321,427, filed 18 Mar. 2022 the contents of which are herein incorporated by reference.

BACKGROUND OF THE INVENTION

The present invention relates to industrial platforms or pallets and more particularly, to a pressure relief pivot attached or integrated to bottom center of a pallet, thereby improving the functionality of the pallet.

A pallet is an industrial platform used to stably support freight while its being lifted or moved by devices such as a forklift or pallet jack.

Pallets are frequently used during the transportation and storage processes because most pallets can carry a relatively large load and still be stored within a warehouse or other spaces (e.g., racking in steel or placement on floor to be stocked). Typically, the spaces where pallets are utilized have narrow passageways with little to no room for changing the orientation of the pallet prior to being lifted.

Conventional pallets include a top deck or upper surface upon which the freight may be placed. The upper portion of the top deck typically has a generally flat or planar surface to facilitate stable placement of the freight. Conventional pallets also typically have a bottom deck or lower surface that is spaced apart from the top deck, wherein the space between the top deck and the bottom deck are dimensioned (to provide two entries) to receive the arms of the forklift or pallet jack moving the pallet. The underside of the bottom decks or lower surfaces are generally flat or planar surface to facilitate stable storage and stacking along a flat supporting surface or floor. Runners and/or stringers interconnect the top and bottom decks and define the two entries.

Loaded pallets are spun or turned—while on the floor—thousands if not hundreds of thousands of times throughout its lifespan by forklifts for facilitating their transport in a desired direction. This pivoting of the pallet is when almost all damage to pallets occurs due to the tight space necessitating the pivoting and mostly the substantial force needed to pivot a conventional pallet loaded with freight. Weight on pallets can exceed 2,500 pound and companies will frequently double stack pallets to take advantage of all packing space (e.g., space in a cube, rack, or trailer), and so thus a bottom pallet sometimes experiences over 3,500 pounds.

Currently all pallets sit perfectly flat on the planar underside of the bottom deck, so that when loaded with weight the pallet becomes very difficult to rotate or spin without damaging or compromising the integrity of the pallet as the associated forklift engagement does not utilize the above mentioned entries in a straightforward manner; rather, the fork engages in a transverse manner so that it can push laterally against the runners of the pallet.

A need exists for a pressure relief pivot attached or integrated to bottom center of a pallet, thereby improving the rotatability of the pallet.

SUMMARY OF THE INVENTION

The pressure relief pivot point embodied in the present invention enables turning or spinning of seated, loaded pallets with a fraction of the force needed compared to a pallet without a pivot point, which in turn allows pallets to last longer due to mitigation of damage to the pallet resulting from lateral/transverse forklift loading because of the lesser amount of force used to pivot the loaded pallet by way of the pivot point.

Furthermore, the pressure relief pivot point is dimensioned and adapted so as not to compromise the integrity or strength of the pallet.

In one aspect of the present invention, a pivotable pallet having a pivot point operatively associated to a balancing point along an underside of the pivotable pallet, wherein the pivot point includes a pressure relief pivot that protrudes out of plane of said underside so that when the pivotable pallet is along a supporting surface, the pressure relief pivot interfaces with said supporting surface, wherein the pivot point/pressure relief pivot is a spherical dome molded during formation of the pivotable pallet, or wherein the pivot point/pressure relief pivot is a spherical cap attached thereto, and wherein the underside is a surface along a bottom deck of the pivotable pallet, wherein the pivotable pallet has a top deck spaced apart from the bottom deck so as to define two entries therebetween dimensioned for receiving forks of a forklift.

In another aspect of the present invention, a method of improving a pallet includes attaching a pivot point to a balancing point along an underside of a bottom deck of said pallet, wherein the pivot point is a spherical cap or a spherical dome.

These and other features, aspects and advantages of the present invention will become better understood with reference to the following drawings, description, and claims.

DETAILED DESCRIPTION OF THE INVENTION

Figure 1:
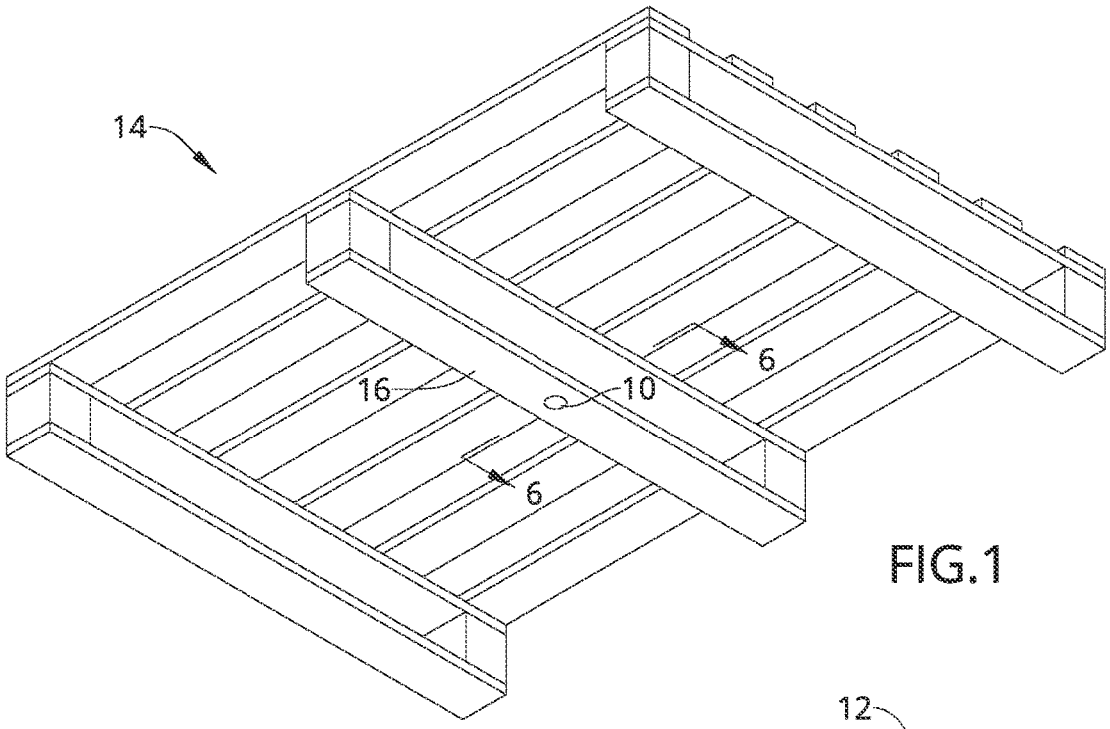
FIG. 1 is a bottom perspective view of an exemplary embodiment of the present invention.
Figure 2:
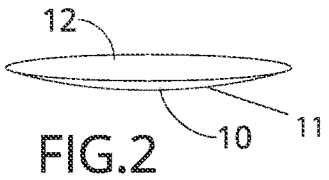
FIG. 2 is a top perspective view of an exemplary embodiment of a pivot point of the present invention.
Figure 3:
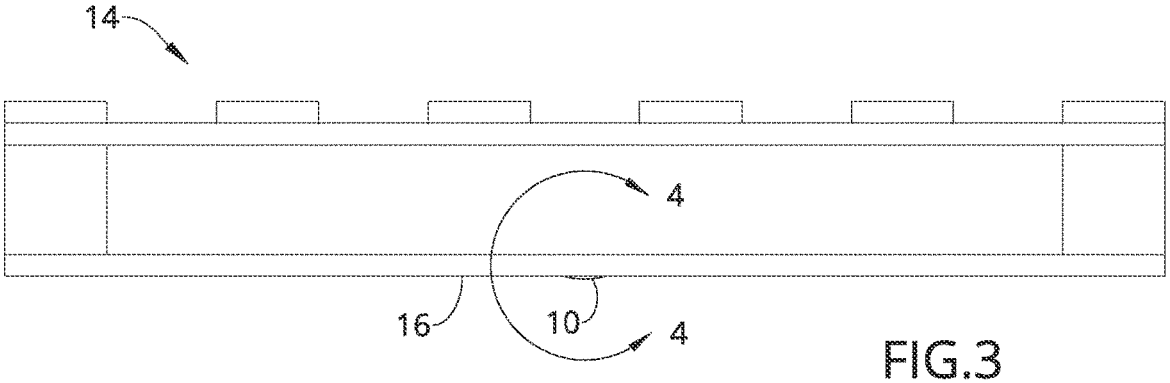
FIG. 3 is a side elevation view of an exemplary embodiment of the present invention.
Figure 4:
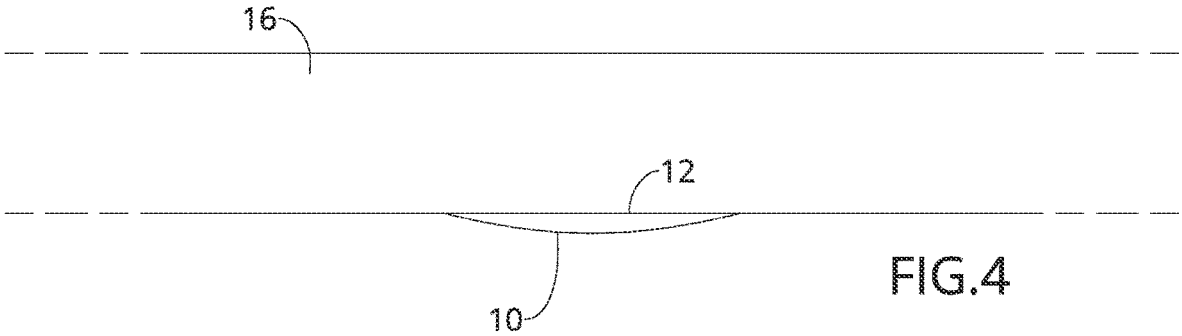
FIG. 4 is a detailed side elevation view of an exemplary embodiment of the present invention, taken along line 4-4 in FIG. 3.
Figure 5:
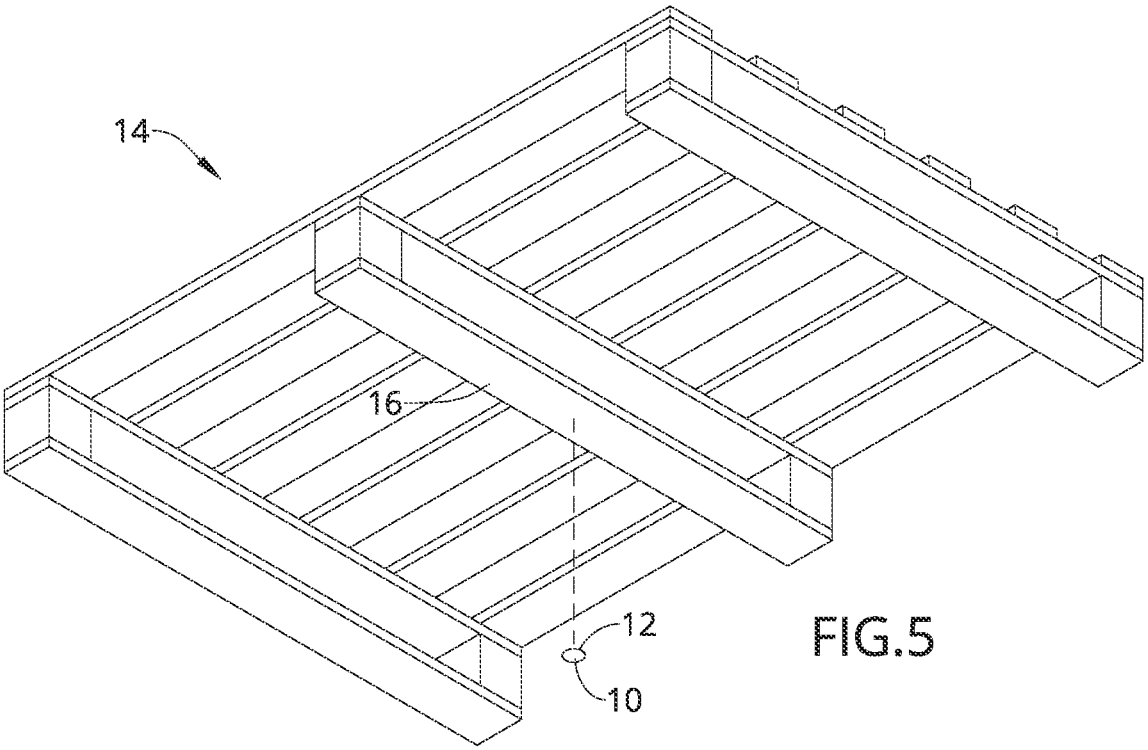
FIG. 5 is an exploded bottom perspective view of an exemplary embodiment of the present invention.
Figure 6:
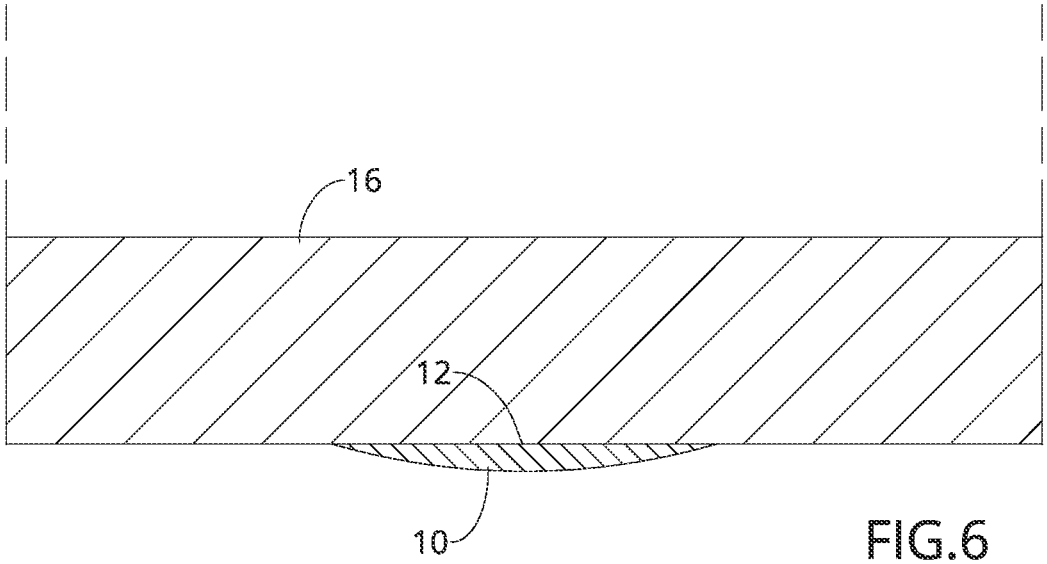
FIG. 6 is a detail section view of an exemplary embodiment of the present invention of FIG. 1 at the balancing point.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a pivot point for pallets that enables their rotation when loaded and seated on a floor. The pivot point may be attached or integrated to a balancing point along an underside of the bottom deck of the pallet.

Referring to FIGS. 1-8, the present invention may include a pressure relief pivot 10 and 22 for a pallet 14 and 20, respectively. The pressure relief pivot 10 may have a spherical cap or spherical dome geometry, wherein the height of the cap is less than the radius of the associated sphere of the spherical cap/dome. The pressure relief pivot 10 may be solid (spherical dome) through its entire height or may be hollowed out, along its inward facing surface 12, have the shape of a contact lens (spherical cap). The diameter of the spherical cap/dome may be between one-and-a-half inches to four or more inches. A height of the spherical cap/dome may be between one-sixth to one or more inches. The term 'pressure relief' connotes that the pivot 10 or 22 interfaces with the supporting surface/floor when the pallet 14/20 is properly placed on said supporting surface/floor, thereby the pivot 10 or 22 carries a substantial amount of the pallet 14/20 weight being located at a balancing point of the pallet 14/20, relieving a substantial amount of the pressure/weight and thus reducing the resulting frictional force applied to a remainder of the underside of the pallet 14/20 so that the pallet 14/20 can easily rotate about the rounded surface of the pivot 14/20.

The pressure relief pivot 10 may be formed with and by way of liquid resin or other material and manufacturer process (e.g., additive manufacturer) may be utilized, as long as the material and manufacturer process enable the functionality disclosed herein. The pressure relief pivot 10 may be rounded and/or sanded along its outward facing surface 11 to provide a suitable tapered or rounded surface on which to pivot a loaded pallet. In one embodiment, the pressure relief pivot 22 may be a spherical dome that is integrated or molded to be part of a molded pallet 20.

The pressure relief pivot point 10/22 may be attached or molded to a central bottom point of the pallet 14/20 along an underside thereof. There are many forms of pallets, and the type of pallet that the present invention is applicable with is not limited to those shown in the drawings. In the drawings, the pressure relief pivot point 10/22 is shown attached to an underside of a bottom deck/lower surface member 16/24.

By central bottom point it is understood that the location of the pressure relief pivot point 10/22 is associated with a surface that would otherwise interface with a supporting surface (e.g., floor), but for the pressure relief pivot 10/22, and wherein this location is a point with respect to which the pallet is balanced with respect to applied forces—e.g., the center of mass of a distribution of mass of the pallet in space (sometimes referred to as the balance point) or point at any given time where the weighted relative position of the distributed mass sums to zero.

Figure 7:
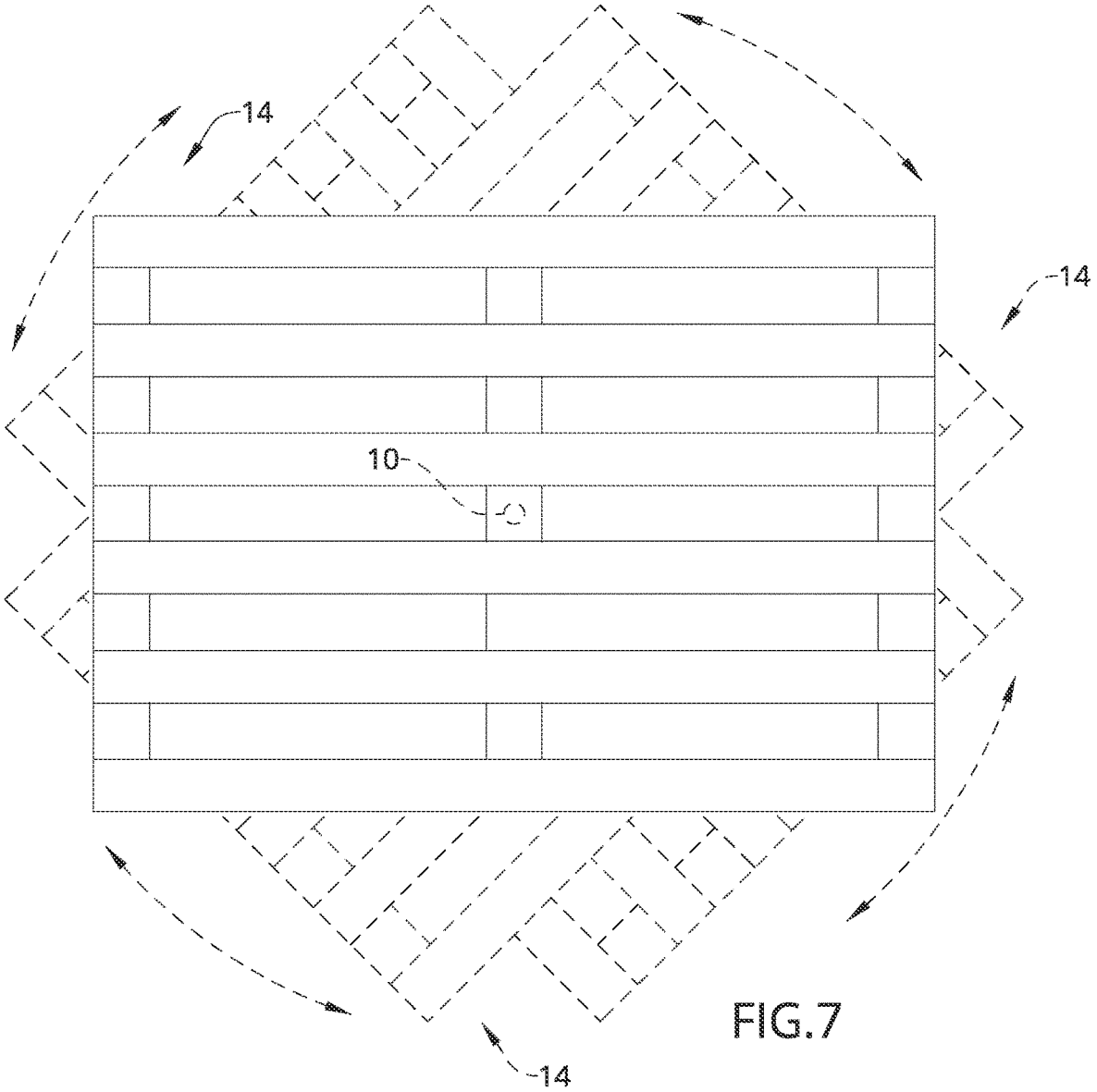
FIG. 7 is a top plan view of an exemplary embodiment of the present invention shown in use, illustrating pivoting about the pivot point.
Figure 8:
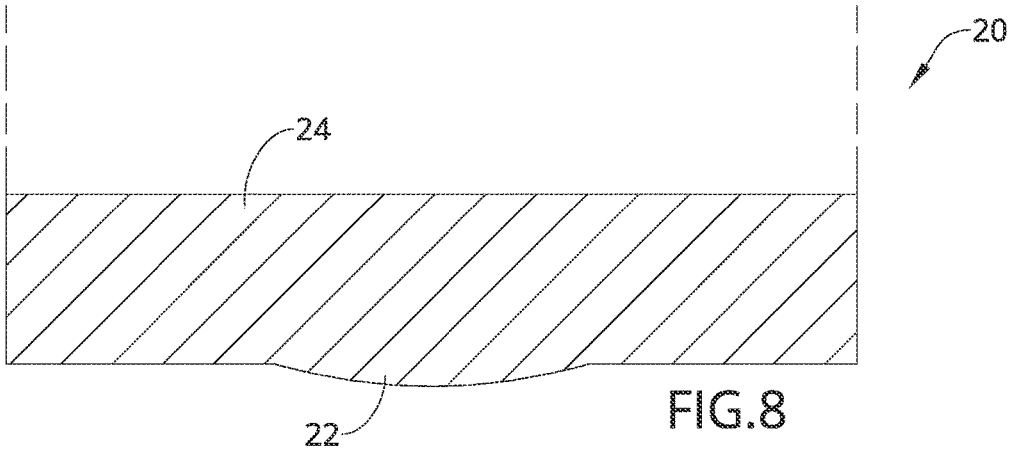
FIG. 8 is a detail section view of an exemplary embodiment of the present invention integrated or molded into a pallet 20.

The present invention embodies the pressure relief pivot 10/22 operatively associated with the balance point along an underside of a pallet 14/20. Accordingly, during use, in contrast to all the weight flatly distributed along the entirety of the underside of a conventional pallet, making it difficult to spin or rotate a pallet, the operatively associated pressure relief pivot 10/22 reduces the friction, enabling rotation or spinning the pallet 14/20, as illustrated in FIG. 7.

The present invention embodies a method of improving a pallet 14, through attaching a pressure relief pivot 10 at the balancing point along an underside of the pallet 14, whereby the pallet 14, even loaded with 3000+ pounds, can now be rotated or spun with a small fraction of the force needed (relative to prior art pallets) resulting in little to no damage to the pallets during the lifespan of the pallet in turn extending the lifespan of the pallet, since this is how 95% of all damages to pallets occur.

Additionally, the present invention may be used in any field of technology moving heavy objects that need to be spun or rotated during any step of the transportation of the product.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the present invention.

What is claimed is:

1. A pivotable pallet having a single pivot point operatively associated to a balancing point along an underside of the pivotable pallet, wherein the single pivot point comprises a pressure relief pivot that protrudes out of plane of said underside so that when the pivotable pallet is along a supporting surface, the pressure relief pivot interfaces with said supporting surface, wherein the pressure relief pivot has an inward facing flat surface directly connected to a central stringer of the pivotable pallet and an outward facing surface defining a spherical dome with a diameter and a height, and wherein the height is between one-and-a-half inches to four inches and the height is between one-sixth to one inch so that the single pivot point is confined within a profile of the central stringer of the pivotable pallet.

2. The pivotable pallet of claim 1, wherein the pressure relief pivot is molded during formation of the pivotable pallet.

3. The pivotable pallet of claim 1, wherein the pressure relief pivot is a spherical cap.

4. A method of improving a pivotability of a pallet, the method comprising attaching a pivot point of claim 1 to a balancing point along an underside of a central stringer of said pallet.

5. The method of claim 4, wherein the pivot point is a spherical cap.

* * * * *